US009378680B2

(12) United States Patent
Chao et al.

(10) Patent No.: US 9,378,680 B2
(45) Date of Patent: Jun. 28, 2016

(54) PIXEL DRIVING CIRCUIT, DRIVING METHOD THEREOF AND DISPLAY PANEL

(71) Applicant: AU Optronics Corp., Hsin-Chu (TW)

(72) Inventors: Ching-Yan Chao, Hsin-Chu (TW); Li-Wei Shih, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 679 days.

(21) Appl. No.: 13/743,354

(22) Filed: Jan. 17, 2013

(65) Prior Publication Data

US 2013/0328848 A1 Dec. 12, 2013

(30) Foreign Application Priority Data

Jun. 7, 2012 (TW) ..... 101120473 A

(51) Int. Cl.
*G09G 3/32* (2016.01)

(52) U.S. Cl.
CPC ..... *G09G 3/3266* (2013.01); *G09G 3/3233* (2013.01); *G09G 2300/0809* (2013.01)

(58) Field of Classification Search
CPC ..... G09G 3/36; G09G 5/10
See application file for complete search history.

(56) References Cited

U.S. PATENT DOCUMENTS 7,800,556 B2 * 9/2010 Chen ..... G09G 3/3233 345/76
2004/0178407 A1 9/2004 Lin
2005/0206591 A1 9/2005 Wang
2012/0105749 A1 * 5/2012 Tseng ..... G02B 27/2242 349/15

FOREIGN PATENT DOCUMENTS

CN 101707046 A 5/2010
TW I230914 4/2005
TW 200735019 9/2007

* cited by examiner

*Primary Examiner* — Michael Faragalla
(74) *Attorney, Agent, or Firm* — Winston Hsu; Scott Margo

(57) ABSTRACT

A pixel driving circuit includes a first switch, a capacitor, a second switch and at least one organic light emitting diode. The first switch includes a first end for receiving data voltage, a control end for receiving a first scan signal, and a second end for outputting the data voltage. The capacitor includes a first end coupled to the second end of the first switch, and a second end. The second switch includes a first end coupled to the second end of the first switch, a control end for receiving a second scan signal, and a second end. The at least one organic light emitting diode includes a first end coupled to the second end of the second switch, and a second end coupled to the second end of the capacitor.

9 Claims, 5 Drawing Sheets

PIXEL DRIVING CIRCUIT, DRIVING METHOD THEREOF AND DISPLAY PANEL

BACKGROUND OF THE INVENTION

1. Field of the Invention

The present invention relates to a pixel driving circuit, especially a pixel driving circuit of an active matrix organic light emitting diode (AMOLED).

2. Description of the Prior Art

Due to their slim shapes, low power consumption and low radiation, liquid crystal displays (LCDs) are widely applied in mobile electronic devices such as notebooks, monitors, and PDAs (personal digital assistants). Besides, the organic light emitting diode (OLED) display can be operated without a backlight source and color filters, and has a slimmer shape and better performance in color, thus the OLED display is also widely used.

Please refer to FIG. 1, which shows a prior art pixel driving circuit 100 applied in an OLED display. As shown in FIG. 1, the pixel driving circuit 100 comprises a first switch M1, a second switch M2, a capacitor C0 and an OLED D1. The first end of the first switch M1 is used to receive the data signal Data, and the control end of the first switch M1 is used to receive the scan signal Scan and to turn on or off the first switch M1 according to the scan signal Scan. The capacitor C0 is coupled to the second end of the first switch M1 for storing the data signal Data to keep the voltage level of the pixel grey level. The control end of the second switch M2 is coupled to the second end of the first switch M1, and the first end of the second switch M2 is coupled to the first voltage source Vdd. The first end of the OLED D1 is coupled to the second end of the second switch M2, and the second end of the OLED D1 is coupled to the second voltage source VSS. When the first switch M1 is turned off, the second switch M2 will be turned on or off according to the voltage level of the data signal Data stored in the capacitor C0, to control the amount of the current I1 flowing through the second switch M2 and the brightness of the OLED D1.

Therefore, the second switch M2 plays an important role as a switch to accurately control the amount of the current I1. If the second switch M2 has a threshold voltage shift, the amount of the current I1 will change accordingly, causing the display using the pixel driving circuit 100 unable to display a correct grey level. Regarding the shift of the threshold voltage, a-Si TFT has a larger threshold voltage shift than poly-Si TFT in the stress process, so that the current provided by a-Si TFT will deteriorate faster than that by poly-Si TFT.

Although there are some compensated circuits designed for solving the aforementioned problem of the pixel driving circuit 100, the number of the total components such as switches and capacitors in the circuits has to be increased. This reduces the aperture ratio of the display, and raises the difficulty to design the driving circuit of a high definition panel.

Moreover, in the prior art pixel driving circuit 100, the current I1 flows through the second switch M2 and the OLED D1. The product of the current I1 and the voltage across the OLED D1 represents the power consumption of the OLED D1. The power consumption of the OLED D1 can only be reduced by improving emission efficiency of the OLED D1. On the other hand, the product of the current I1 and the voltage across the second switch M2 represents the power consumption of the pixel driving circuit 100. This portion of the power consumption can be reduced by reducing the amount of the current I1 or reducing the amount of the voltage across the second switch M2.

SUMMARY OF THE INVENTION

An embodiment of the present invention relates to a pixel driving circuit, which comprises a first switch, a capacitor, a second switch and at least one organic light emitting diode. The first switch has a first end for receiving a data voltage, a control end for receiving a first scan signal, and a second end for outputting the data voltage. The capacitor has a first end coupled to the second end of the first switch, and a second end. The second switch has a first end coupled to the second end of the first switch, a control end for receiving a second scan signal, and a second end. The at least one organic light emitting diode has a first end coupled to the second end of the second switch, and a second end.

Another embodiment of the present invention relates to a method for driving a pixel driving circuit. The pixel driving circuit comprising a first switch, a capacitor, a second switch and at least one OLED, a second end of the first switch being coupled to a first end of the capacitor and a first end of the second switch, a second end of the second switch being coupled to a first end of the at least one OLED. The method comprises turning on the first switch to store a data voltage in the capacitor, and turning off the first switch and turning on the second switch so as to output the data voltage stored in the capacitor to the at least one OLED.

Another embodiment of the present invention relates to a display panel, which comprises a plurality of gate lines, a plurality of data lines, a gate driver, a source driver, a timing controller and a plurality of pixel driving circuits. The gate driver is coupled to the gate lines for outputting scan signals to the gate lines. The source driver is coupled to the data lines for outputting data voltages to the data lines. The timing controller is coupled to the gate driver and the source driver for outputting timing control signals to the gate driver and the source driver, to control timings of the gate driver and the source driver. Each pixel driving circuit of the plurality of pixel driving circuits comprises a first switch, a capacitor, a second switch and at least one organic light emitting diode. The first switch has a first end for receiving a data voltage, a control end for receiving a first scan signal, and a second end for outputting the data voltage. The capacitor has a first end coupled to the second end of the first switch, and a second end. The second switch has a first end coupled to the second end of the first switch, a control end for receiving a second scan signal, and a second end. The at least one organic light emitting diode has a first end coupled to the second end of the second switch, and a second end.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
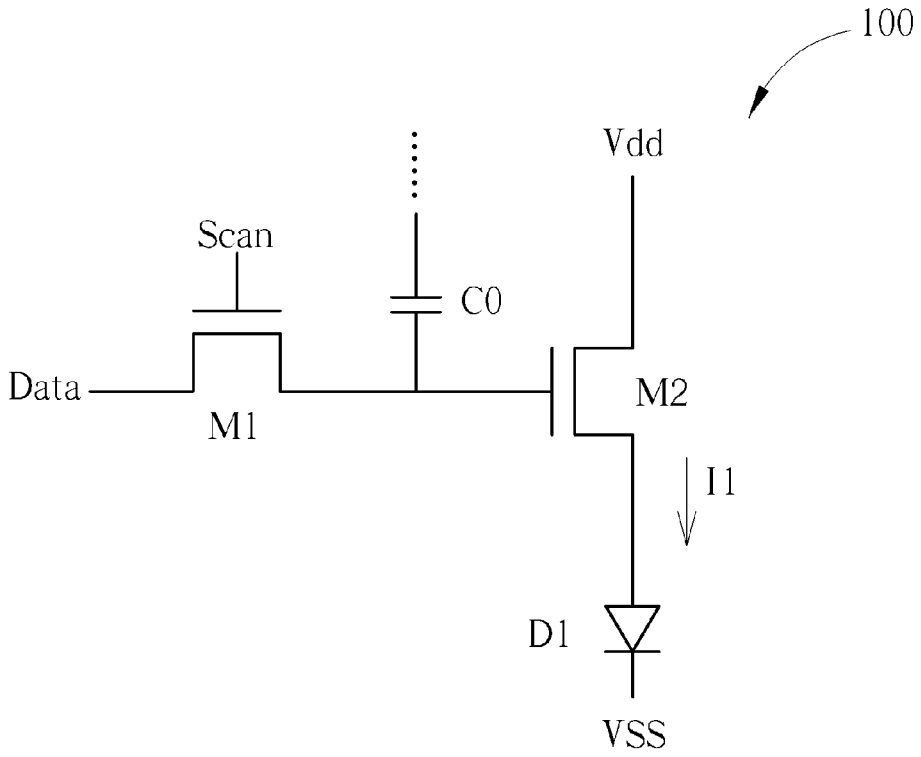
FIG. 1 PRIOR ART
FIG. 1 shows a prior art pixel driving circuit applied in an OLED display.

The detailed descriptions of the present invention are exemplified below in examples. However, the examples are merely used to illustrate the present invention, not to limit the present invention. Because one skilled in the art may modify the present invention or combine the present invention with some features within the scope of the present invention, the claimed scope of the present invention should be referred to in the following claims.

In the entire specification and claims, unless the contents clearly specify the meaning of some terms, the terms "a" or "the" may refer to one or at least one of elements or components. Besides, in the present disclosure, unless it can be clearly seen from the relating context that the examples or embodiments do not refer to multiple elements or components, singular articles may refer to one or at least one of elements or components. The meanings of every term used in the present claims and specification refer to a usual meaning known to one skilled in the art unless the meaning is additionally annotated. Some terms used to describe the present invention will be discussed to guide practitioners about the present invention. Every example in the present specification cannot limit the claimed scope of the present invention.

The terms "substantially," "around," "about" and "approximately" can refer to within 20% of a given value or range, and preferably within 10%. Besides, the quantities provided herein can be approximate ones and can be described with the aforementioned terms if are without being specified. When a quantity, density, or other parameters includes a specified range, preferable range or listed ideal values, their values can be viewed as any number within the given range. For example, if it is described that the length of a component is X cm to Y cm, then it is equivalent to sentence "the length of the component is H, and H can be any real number value between the values of X and Y."

Further, in the present specification and claims, the term "comprising" is open type and should not be viewed as the term "consisted of." Besides, the term "electrically coupled" can be referring to either directly connecting or indirectly connecting between elements. Thus, if it is described in the below contents of the present invention that a first device is electrically coupled to a second device, the first device can be directly connected to the second device, or indirectly connected to the second device through other devices or means. Moreover, when the transmissions or generations of electrical signals are mentioned, one skilled in the art should understand some degradations or undesirable transformations could be generated during the operations. If it is not specified in the specification, an electrical signal at the transmitting end should be viewed as substantially the same signal as that at the receiving end. For example, when the end A of an electrical circuit provides an electrical signal S to the end B of the electrical circuit, the voltage of the electrical signal S may drop due to passing through the source and drain of a transistor or due to some parasitic capacitance. However, the transistor is not deliberately used to generate the effect of degrading the signal to achieve some result, that is, the signal S at the end A should be viewed as substantially the same as that at the end B.

Furthermore, it can be understood that the terms "comprising," "including," "having," "containing," and "involving" are open-ended terms, which refer to "may include but is not limited to so." Besides, each of the embodiments or claims of the present invention is not necessary to achieve all the effects and advantages possibly to be generated, and the abstract and title of the present invention is used to assist for patent search and is not used to further limit the claimed scope of the present invention.

The embodiments and figures are provided as follows in order to illustrate the present invention in detail, but the claimed scope of the present invention is not limited by the provided embodiments and figures.

Figure 2:
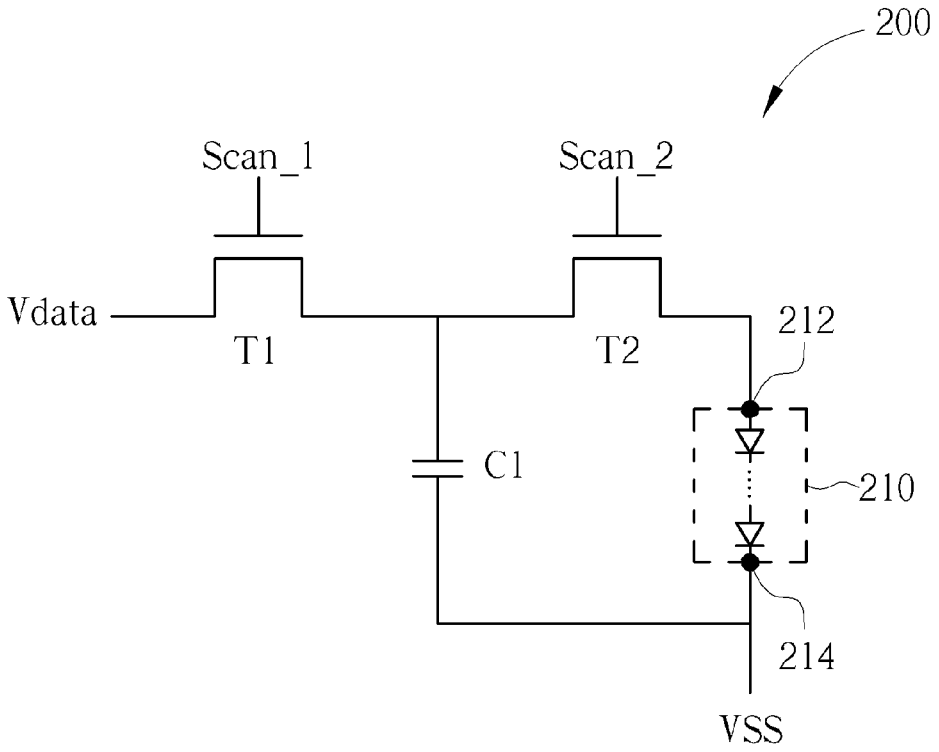
FIG. 2 shows a pixel driving circuit according to a first embodiment of the present invention.

Please refer to FIG. 2, which shows a pixel driving circuit 200 according to a first embodiment of the present invention. As shown in FIG. 2, the pixel driving circuit 200 includes a first switch T1, a capacitor C1, a second switch T2 and a set of OLEDs 210. The first switch T1 has a first end for receiving a data voltage Vdata, a control end for receiving a first scan signal Scan_1, and a second end for outputting the data voltage Vdata. The capacitor C1 has a first end coupled to the second end of the first switch T1, and a second end. The second switch T2 has a first end coupled to the second end of the first switch T1, a control end for receiving a second scan signal Scan_2, and a second end. The set of OLEDs 210 has a first end 212 coupled to the second end of the second switch T2, and a second end 214 for receiving a reference voltage VSS coupled to the second end of the capacitor C1.

In the pixel driving circuit 200 of the first embodiment, the first switch T1 and the second switch T2 can be n-type metal oxide semiconductors (NMOS), and the reference voltage VSS can be ground voltage, zero voltage or negative voltage. Besides, the set of OLEDs 210 comprises a plurality of OLEDs coupled in series. However, the OLEDs of the set of OLEDs 210 are not limited to being coupled in series, and the set of OLEDs 210 can be also configured to comprise only one OLED. Further, the first switch T1, the second switch T2 and other switches can be replaced with p-type metal oxide semiconductors (PMOS).

In the pixel driving circuit 200 of the first embodiment, the first switch T1 and the second switch T2 are used to control charging or discharging of the capacitor C1. The voltage for driving the set of OLEDs 210 is provided by the charges of the data voltage Vdata stored in the capacitor C1. The second switch T2 partially or totally releases the stored charges, and the voltage of the capacitor C1 is reduced in each frame by discharging of the capacitor C1. The brightness of the gray level is determined by the amount of charges flowing through the set of OLEDs 210, and the charges flowing through the set of OLEDs 210 is determined by the data voltage Vdata. Thus, even if the threshold voltage of the second switch T2 has a shift, it is insensitive to the total amount of charge through the second switch T2, the pixel driving circuit 200 is still capable of displaying grey levels with correct brightness.

Besides, in the pixel driving circuit 200 of the first embodiment, the voltage across the second switch T2 (Vds) can be reduced by raising the second scan signal Scan_2; or the current flowing through the set of OLEDs 210 is reduced by configuring the set of OLEDs 210 to comprise multiple OLEDs coupled in series. Thus, the power consumption of the pixel driving circuit 200 can be reduced by the previous methods, while the brightness of the set of OLEDs 210 is maintained.

Figure 3:
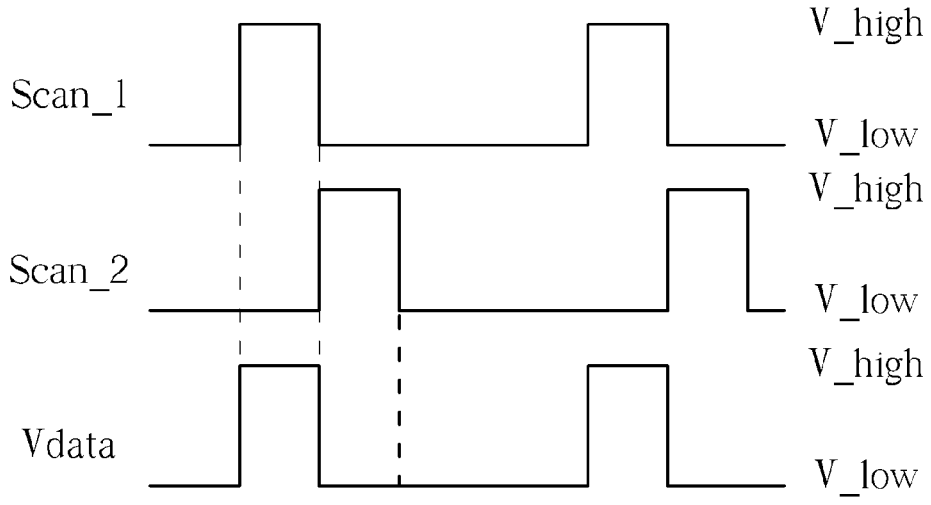
FIG. 3 shows a timing diagram of the pixel driving circuit in FIG. 2.

Please refer to FIG. 3, which shows a timing diagram of the pixel driving circuit 200 in FIG. 2. As shown in FIG. 3, when operating the pixel driving circuit 200, the voltage level of the first scan signal Scan_1 is switched to high to turn on the first switch T1, so that the data voltage Vdata can be stored in the capacitor C1. And then, after the data voltage Vdata is stored, the voltage level of the first scan signal Scan_1 is switched to low to turn off the first switch T1, and the voltage level of the second scan signal Scan_2 is switched to high to turn on the second switch T2, so that the data voltage Vdata stored in the capacitor C1 can be outputted to the set of OLEDs 210.

Figure 4:
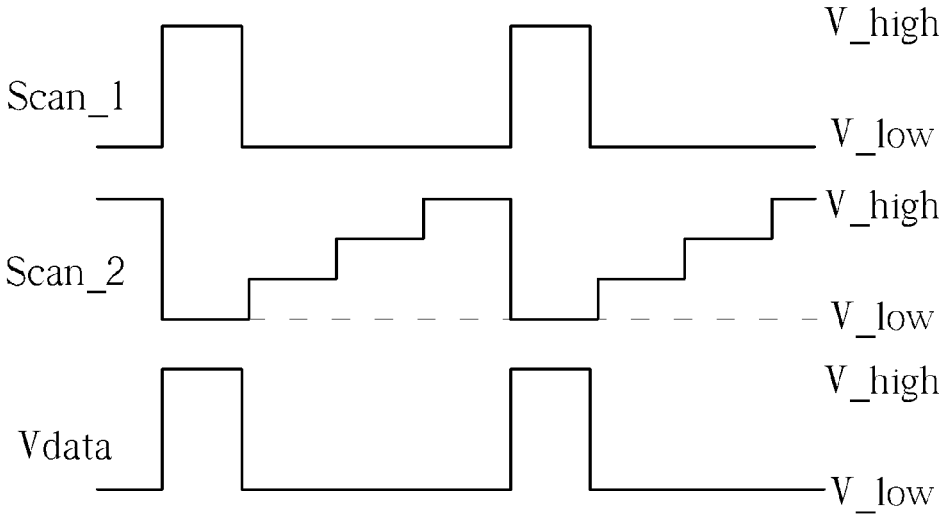
FIG. 4 shows another timing diagram of the pixel driving circuit in FIG. 2.

Please refer to FIG. 4, which shows another timing diagram of the pixel driving circuit 200 in FIG. 2. The difference between the FIGS. 3 and 4 is that, in FIG. 3, when outputting the data voltage Vdata stored in the capacitor C1 to the set of OLEDs 210, the second scan signal Scan_2 is instantaneously changed from low to high. However, in FIG. 4, when outputting the data voltage Vdata stored in the capacitor C1 to the set of OLEDs 210, the second scan signal Scan_2 first provides the control end of the second switch T2 with a voltage not smaller than the threshold voltage of the second switch T2, and then raises the voltage level of the voltage provided to the control end of the second switch T2 in a stepped manner according to remaining charges of the capacitor C1. The voltage not smaller than the threshold voltage of the second switch T2 is between a low voltage level and a high voltage level, and to fully turn on the second switch T2 requires the high voltage level to be inputted to the control end of the second switch T2. Through the timing diagram in FIG. 4, instantaneous discharge of the capacitor C1 to light on the set of OLEDs 210 instantaneously can be avoided to extend the life time of the set of OLEDs 210. Please notice that in FIGS. 3 and 4, V_high denotes a high voltage level and V_low denotes a low voltage level. However, both V_high and V_low are not limited to specific values.

In the embodiments illustrated above and below, the switches can be n-type TFT, and the reference voltage can be ground voltage, zero voltage or negative voltage. The n-type TFT can be replaced by p-type TFT and a modified timing diagram for driving. Further, the semiconductor materials of the switches are not limited, the semiconductor materials of the switches can be poly-Si, micro-Si, a-Si or metal oxide.

Figure 5:
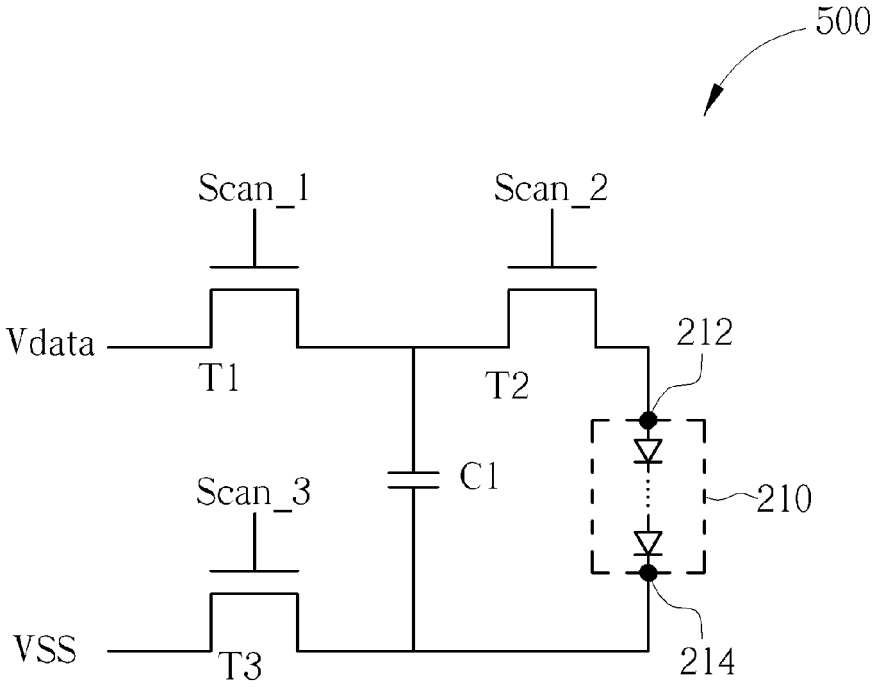
FIG. 5 shows a pixel driving circuit according to a second embodiment of the present invention.

Please refer to FIG. 5, which shows a pixel driving circuit 500 according to a second embodiment of the present invention. As shown in FIG. 5, the difference between the pixel driving circuits 200 and 500 is that the pixel driving circuit 500 further comprises a third switch T3. The third switch T3 has a first end coupled to a reference voltage source VSS, a control end for receiving a third scan signal Scan_3, and a second end coupled to the second end 214 of the set of OLEDs 210 and the second end of the capacitor C1. In the second embodiment, the operation of the third switch T3 is synchronous to the first switch T1. The turned-off third switch T3 will reduce the impact of the voltage variation of the reference voltage VSS to the set of OLEDs 210 and keep the image quality of the display.

Figure 6:
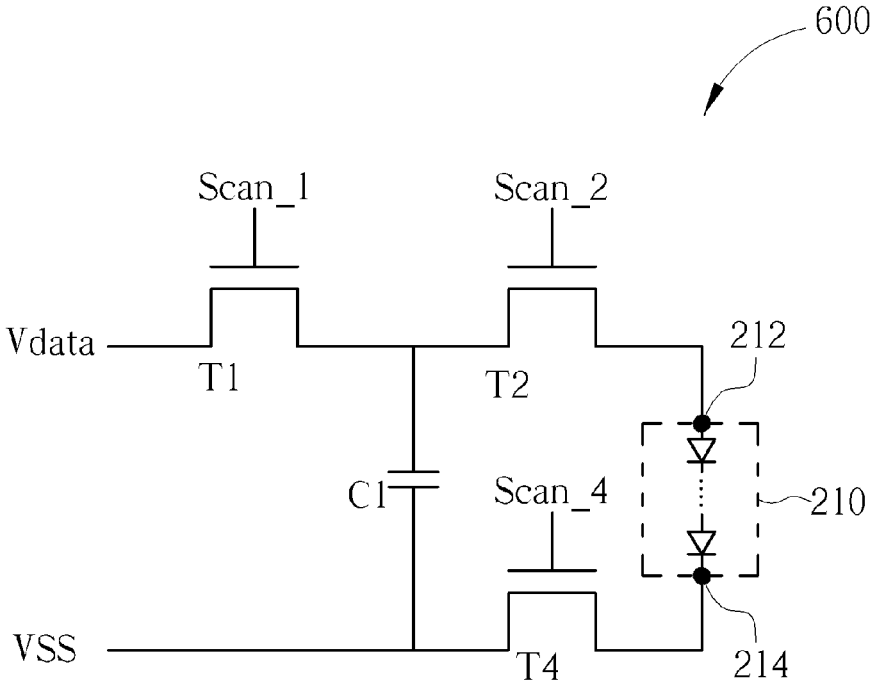
FIG. 6 shows a pixel driving circuit according to a third embodiment of the present invention.

Please refer to FIG. 6, which shows a pixel driving circuit 600 according to a third embodiment of the present invention. As shown in FIG. 6, the difference between the pixel driving circuits 200 and 600 is that the pixel driving circuit 600 further comprises a fourth switch T4. The fourth switch T4 has a first end coupled to the second end of the capacitor C1 and for receiving the reference voltage VSS, a control end for receiving a fourth scan signal Scan_4, and a second end coupled to the second end 214 of the set of OLEDs 210. In the third embodiment, the operation of the fourth switch T4 is synchronous to the second switch T2, thus the pixel driving circuit 600 can protect the set of OLEDs 210 by controlling the fourth switch T4. When charging the capacitor C1, the second switch T2 and the fourth switch T4 are both turned off. Thus the turned-off second switch T4 can prevent the set of OLEDs 210 from being damaged by the transient voltage of the data voltage Vdata, and the turned-off fourth switch T4 can prevent the voltage variation of the reference voltage VSS to the set of OLEDs 210.

Figure 7:
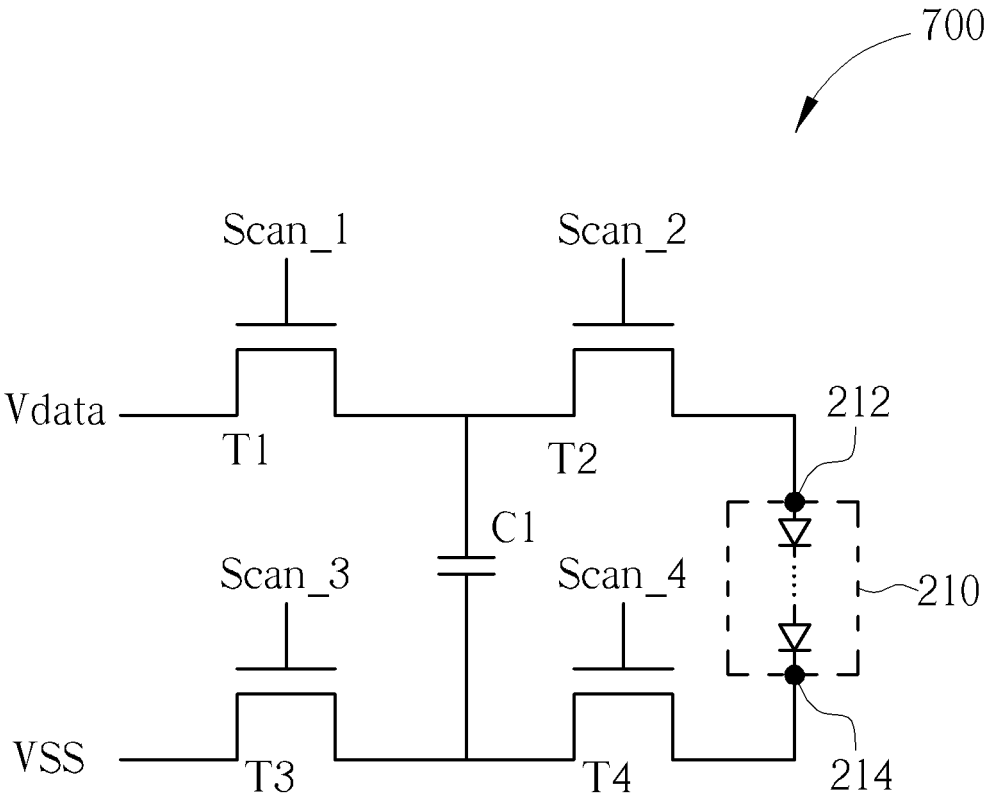
FIG. 7 shows a pixel driving circuit according to a fourth embodiment of the present invention.

Please refer to FIG. 7, which shows a pixel driving circuit 700 according to a fourth embodiment of the present invention. As shown in FIG. 7, the difference between the pixel driving circuits 600 and 700 is that the pixel driving circuit 700 further comprises a third switch T3. The third switch T3 has a first end for receiving the reference voltage VSS, a control end for receiving the third scan signal Scan_3, and a second end coupled to the second end of the capacitor C1 and the first end of the fourth switch T4.

In the fourth embodiment, the operation of the third switch T3 is synchronous to the first switch T1, and the operation of the fourth switch T4 is synchronous to the second switch T2. When discharging the capacitor, the turned-off third switch T3 will reduce the impact of the voltage variation of the reference voltage VSS to the set of OLEDs 210 and keep the image quality of the display. When charging the capacitor C1, the turned-off fourth switch T4 can prevent the set of OLEDs 210 from being damaged by the transient voltage of the data voltage Vdata, and when discharging the capacitor C1, the turned-off fourth switch T4 can prevent the voltage variation of the reference voltage VSS to the set of OLEDs 210.

Figure 8:
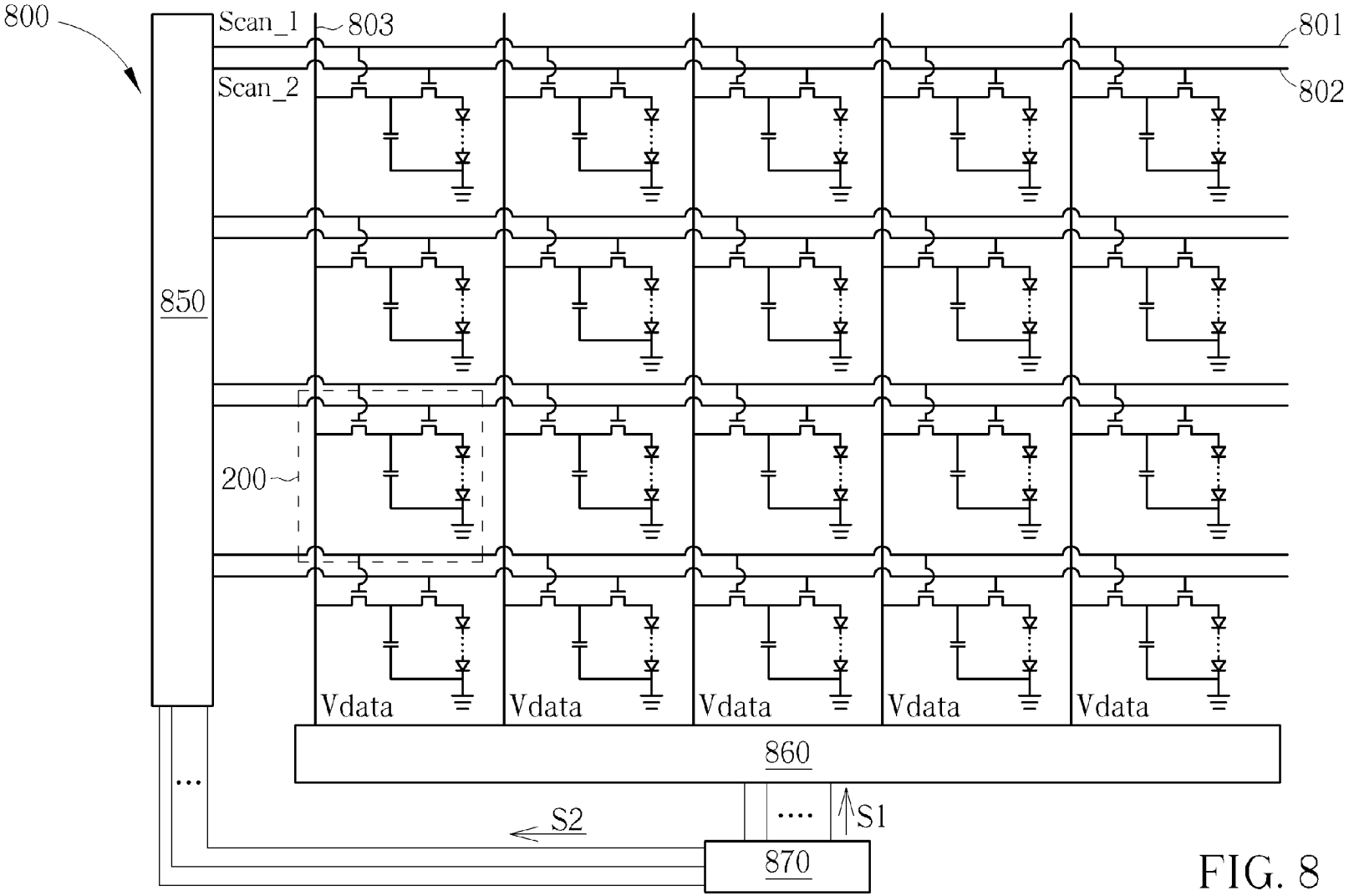
FIG. 8 shows a display panel according to a fifth embodiment of the present invention.

Please refer to FIG. 8, which shows a display panel 800 according to a fifth embodiment of the present invention. The pixel driving circuits in the display panel 800 can be referred to the pixel driving circuit 200 of the first embodiment. As shown in FIG. 8, the display panel 800 comprises a plurality of first gate lines 801, a plurality of second gate lines 802, a plurality of data lines 803, a gate driver 850, a source driver 860, a timing controller 870 and a plurality of pixel driving circuits 200. The gate driver 850 is coupled to the first gate lines 801 and the second gate lines 802 for outputting the first scan signal Scan_1 to the first gate lines 801, and outputting the second scan signal Scan_2 to the second gate lines 802. The source driver 860 is coupled to the data lines 803 for outputting data voltages to the data lines 803. The timing controller 870 is coupled to the gate driver 850 and the source driver 860 for outputting the timing control signal S2 to the gate driver 850 and outputting the timing control signal S1 to the source driver 860, to control timings of the gate driver 850 and the source driver 860. Besides, the pixel driving circuits 200 in the fifth embodiment can be replaced with a plurality of pixel driving circuits 500, 600 or 700 with suitable modifications.

In view of above, through the configuration of the pixel driving circuits 200, 500, 600 and 700 and the display panel 800, the set of OLEDs 210 is powered by the charges stored in the capacitor C1. The second switch T2 releases the stored charges partially or completely, thus the voltage level of the capacitor C1 will gradually decrease in each frame. Because the brightness of the grey level relates to amount of the current flowing through the set of OLEDs 210, and the current flowing through the set of OLEDs 210 relates to the data voltage stored in the capacitor C1, even if the threshold voltage of the second switch T2 is shifted, the display applying the pixel driving circuit 200, 500, 600 and 700 and the display panel 800 can still correctly display images. Besides, the voltage across the second switch T2 can be reduced by raising the second scan signal Scan_2; or the current flowing through the set of OLEDs 210 is reduced by configuring the set of OLEDs 210 to comprise multiple OLEDs coupled in series. Thus, the power consumption of the pixel driving circuit 200 can be reduced by the previous methods, while the brightness of the set of OLEDs 210 is maintained.

In the embodiments of the present invention, the first switch T1 is used to control the capacitor C1 to receive the data voltage, and the second switch T2 is used to control the set of the OLEDs 210 to receive the data voltage from the capacitor C1. In the prior art pixel driving circuit 100 of FIG. 1, the data voltage stored in the capacitor C0 is used to control the control end of the second switch M2, and the threshold voltage of each switch M2 in a display needs to be as consistent as possible to ensure that the second switch M2 can correctly control the amount of the current I1. However, in the embodiments of the present invention, the set of OLEDs 210 is powered by the data voltage stored in the capacitor C1, and the second switch T2 is used to partially or completely release the data voltage stored in the capacitor C1 to the set of OLEDs 210, thus the voltage level of the capacitor C1 will be gradually decreased in each frame along with the discharging of the capacitor C1. Because the brightness of the grey level relates to amount of the current flowing through the set of OLEDs 210, and the current flowing through the set of OLEDs 210 relates to the data voltage stored in the capacitor C1, even if the threshold voltage of the second switch T2 is shifted, the display can still correctly display images.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel driving circuit, comprising:

a first switch, having a first end for receiving a data voltage, a control end for receiving a first scan signal, and a second end for outputting the data voltage;

a capacitor having a first end coupled to the second end of the first switch, and a second end;

a second switch having a first end coupled to the second end of the first switch, a control end for receiving a second scan signal, and a second end; and at least one organic light emitting diode (OLED), having a first end coupled to the second end of the second switch, and a second end coupled to the second end of the capacitor;

wherein:

the first scan signal and the second scan signal are complementary;

when the first switch is turned on, the data voltage is stored to the capacitor; and when the second switch is turned on, the first switch is turned off and the data voltage stored in the capacitor is outputted through the second switch to drive the at least one OLED.

2. The pixel driving circuit of claim 1, wherein both the second end of the capacitor and the second end of the at least one OLED are coupled to a low voltage source.

3. The pixel driving circuit of claim 1, further comprising:

a third switch, having a first end coupled to a low voltage source, a control end for receiving a third scan signal, and a second end coupled to the second end of the at least one OLED and the second end of the capacitor;

wherein the first scan signal and the third scan signal have a same phase.

4. The pixel driving circuit of claim 1, further comprising:

a fourth switch, having a first end coupled to the second end of the capacitor and a low voltage source, a control end for receiving a fourth scan signal, and a second end coupled to the second end of the at least one OLED;

wherein the second scan signal and the fourth scan signal have a same phase.

5. The pixel driving circuit of claim 1, further comprising:

a third switch having a first end coupled to a low voltage source, a control end for receiving a third scan signal, and a second end coupled to the second end of the capacitor; and a fourth switch having a first end coupled to the second end of the capacitor, a control end for receiving a fourth scan signal, and a second end coupled to the second end of the at least one OLED;

wherein:

the first scan signal and the third scan signal have a same phase; and the second scan signal and the fourth scan signal have a same phase.

6. A pixel driving circuit, comprising:

a first switch, having a first end for receiving a data voltage, a control end for receiving a first scan signal, and a second;

a second switch having a first end directly coupled to the second end of the first switch, a control end for receiving a second scan signal, and a second end;

a capacitor having a first end directly coupled to the second end of the first switch, and a second end coupled to a low voltage source; and an organic light emitting diode (OLED), having an anode end directly coupled to the second end of the second switch, and a cathode end coupled to the second end of the capacitor.

7. A pixel driving circuit, comprising:

a first switch, having a first end for receiving a data voltage, a control end for receiving a first scan signal, and a second end;

a second switch having a first end directly coupled to the second end of the first switch, a control end for receiving a second scan signal, and a second end;

a capacitor having a first end directly coupled to the second end of the first switch for storing the data voltage, and a second end coupled to a low voltage source; and an organic light emitting diode (OLED), having an anode end directly coupled to the second end of the second switch, and a cathode end coupled to the second end of the capacitor;

wherein:

the first scan signal and the second scan signal are complementary;

when the first switch is turned on, the data voltage is stored to the capacitor; and when the second switch is turned on, the first switch is turned off and the data voltage stored in the capacitor is outputted through the second switch to the OLED.

8. The pixel driving circuit of claim 7, further comprising:

a third switch, having a first end coupled to the low voltage source, a control end for receiving a third scan signal, and a second end coupled to the cathode end of the OLED and the second end of the capacitor;

wherein the first scan signal and the third scan signal have a same phase.

9. The pixel driving circuit of claim 7, further comprising:

a fourth switch, having a first end coupled to the second end of the capacitor and the low voltage source, a control end for receiving a fourth scan signal, and a second end coupled to the second end of the OLED, wherein the second scan signal and the fourth scan signal have a same phase.

* * * * *